US009278797B2

(12) United States Patent
Hoekstra et al.

(10) Patent No.: US 9,278,797 B2
(45) Date of Patent: Mar. 8, 2016

(54) CUP

(75) Inventors: Aad Hoekstra, ae Zutphen (NL); Neil Marshall, Fareham Hants (GB); Steve Knipe, Portsmouth (GB)

(73) Assignee: HUHTAMAKI OYJ, Espoo (FI)

( * ) Notice: Subject to any disclaimer, the term of this patent is extended or adjusted under 35 U.S.C. 154(b) by 673 days.

(21) Appl. No.: 13/130,685

(22) PCT Filed: Nov. 23, 2009

(86) PCT No.: PCT/EP2009/065673

§ 371 (c)(1),
(2), (4) Date: Jul. 26, 2011

(87) PCT Pub. No.: WO2010/058016

PCT Pub. Date: May 27, 2010

(65) Prior Publication Data

US 2011/0272459 A1 Nov. 10, 2011

(30) Foreign Application Priority Data

Nov. 24, 2008 (DE) ..... 10 2008 058 797
Mar. 20, 2009 (DE) ..... 10 2009 013 732

(51) Int. Cl.

| | |
|---|---|
| ***B65D 3/22*** | (2006.01) |
| ***B65D 81/38*** | (2006.01) |
| ***B65D 25/20*** | (2006.01) |
| ***B65D 25/54*** | (2006.01) |

(52) U.S. Cl.

CPC ..... *B65D 81/3869* (2013.01); *B65D 3/22* (2013.01); *B65D 25/205* (2013.01); *B65D 25/54* (2013.01); *B65D 81/3865* (2013.01); *B65D 81/3874* (2013.01); *B65D 2205/02* (2013.01)

(58) Field of Classification Search

CPC ... B65D 3/22; B65D 81/3865; B65D 81/3869
USPC ..... 229/403; 220/592.17, 592.2, 592.24, 220/738, 739

See application file for complete search history.

(56) References Cited

U.S. PATENT DOCUMENTS

| | | | | | |
|---|---|---|---|---|---|
| 3,908,523 | A | * | 9/1975 | Shikaya | 493/111 |
| 4,171,085 | A | * | 10/1979 | Doty | 229/400 |
| 4,706,873 | A | * | 11/1987 | Schulz | 229/400 |
| 4,993,580 | A | | 2/1991 | Smith | |
| 5,071,060 | A | * | 12/1991 | DeFelice | 229/403 |
| 5,226,585 | A | * | 7/1993 | Varano | 229/400 |

(Continued)

FOREIGN PATENT DOCUMENTS

| | | | |
|---|---|---|---|
| DE | 202006018406 | U1 | 5/2008 |
| EP | 1785370 | A1 | 5/2007 |

(Continued)

*Primary Examiner* — Gary Elkins
(74) *Attorney, Agent, or Firm* — Husch Blackwell LLP

(57) ABSTRACT

Cup having a base and an adjoining shell, it being possible for the shell to be provided with a mouth roll at its opposite end to the base and to be configured with a single layer or multiple layers, at least one layer of the shell being produced from paper or cardboard or other comparable materials, at least one layer of the shell being provided with elevations and/or depressions substantially over its entire height and at least approximately the entire circumference, the difference in depth between the maximum elevation or depression and the material layer or the depression or elevation varying over the height of the shell and/or over the circumference, and it being possible for the mouth roll to be formed integrally on the inner layer or the only layer.

15 Claims, 9 Drawing Sheets

(56) References Cited

U.S. PATENT DOCUMENTS

Figure 1:
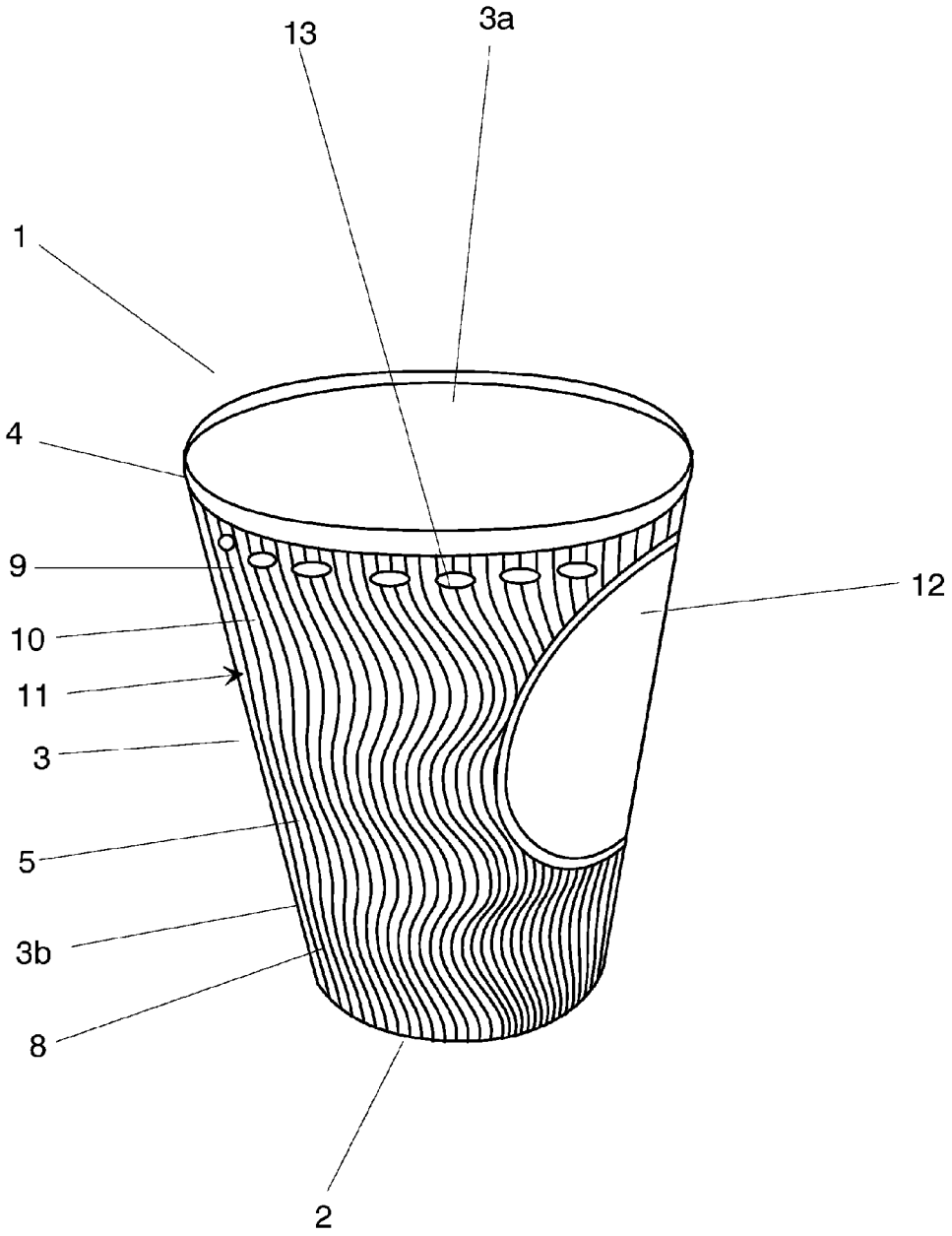

| | | | | | |
|---|---|---|---|---|---|
| 5,415,339 | A | * | 5/1995 | Howard | 229/403 |
| 5,547,124 | A | * | 8/1996 | Mueller | 229/403 |
| 5,725,916 | A | * | 3/1998 | Ishii et al. | 229/403 |
| 5,766,709 | A | * | 6/1998 | Geddes et al. | 229/403 |
| 5,769,311 | A | | 6/1998 | Morita et al. | |
| 5,772,111 | A | | 6/1998 | Kirsch | |
| 5,820,016 | A | * | 10/1998 | Stropkay | 229/403 |
| 5,964,400 | A | | 10/1999 | Varano et al. | |
| 8,006,861 | B2 | * | 8/2011 | Kim | 220/738 |
| 8,146,797 | B2 | * | 4/2012 | D'Amato | 229/403 |
| 2005/0258225 | A1 | | 11/2005 | Martin | |
| 2007/0284426 | A1 | * | 12/2007 | Lo | 229/403 |
| 2010/0072268 | A1 | * | 3/2010 | Johnson et al. | 229/403 |

FOREIGN PATENT DOCUMENTS

| | | | |
|---|---|---|---|
| WO | 2007126783 | A1 | 11/2007 |
| WO | 2008045708 | A1 | 4/2008 |

* cited by examiner

CUP

The invention relates to a cup having a base and an adjoining shell, it being possible for the shell to be provided with a mouth roll at its opposite end to the base and to be configured with a single layer or multiple layers, at least one layer of the shell being produced from paper or cardboard or other comparable materials.

A multiplicity of different cups of this type are known. Single-walled or multiple-walled cups are often used. Multiple-walled cups are used, above all, in the case of hot or cooled drinks, since single-walled cups can often be unpleasant to the touch in these cases.

In all cup variants, however, there is the problem that they can be gripped only unpleasantly. This problem occurs, above all, in the case of cups which are provided with a wavy layer. In addition, there is also often the problem that the outer side of the cups is unpleasantly hot or unpleasantly cold depending on the contents.

Furthermore, cups of this type can be printed only poorly with information and advertising.

The invention is therefore based on the object of proposing a cup design which, in addition to satisfactory insulation properties, also has satisfactory tactile properties and, in addition, can be provided readily with information and/or advertising.

According to the invention, this object is achieved by the fact that at least one layer of the shell is provided with elevations and/or depressions substantially over its entire height and at least approximately the entire circumference, the difference in depth between the maximum elevation or depression and the material layer or the depression or elevation varying over the height of the shell and/or over the circumference, and by the fact that the mouth roll can be formed integrally on the inner layer or the only layer.

As a result, the cup nestles very satisfactorily in the hand during gripping. It can be gripped securely. Nevertheless, the stacking capability is not influenced negatively. In addition, very satisfactory insulation is ensured in the case of a multiple-layered cup.

It has proven very advantageous here if the spacing between two adjacent elevations or depressions varies over the height of the shell.

This achieves a very satisfactory adaptation to the cup shape, without undesirable folds being produced.

According to the invention, it is very advantageous if the elevations and/or depressions are formed as embossed formations.

The embossed formations provide a very great freedom in the design of the elevations and the depressions.

It is likewise very advantageous if a plurality of discrete embossed formations which are configured as shaped elements are distributed over the shell and together form the elevations and depressions.

As a result, the shell can also be designed very appealingly, it being conceivable that shapes, designs and advertising can be represented by these embossed formations.

A further very advantageous refinement of the invention is also present if the elevations and/or depressions are arranged in the form of lines.

In the case of a multiple-layer shell, air channels can be produced by the use of lines, with the result that at least the outer side of the shell is kept equalized to the ambient temperature by convection. However, it is also conceivable that the contact area to the hand of the user is reduced by a refinement of this kind in the case of a single-layer shell.

According to the invention, it is likewise very advantageous if the elevations and/or depressions are arranged in the form of wavy lines.

The cup lies in the hand even more satisfactorily by way of wavy lines of this type.

It is also extremely advantageous if the lines run at least approximately in the height direction of the shell.

As a result, convection which occurs is assisted not only on the outer side of the shell.

According to a further refinement of the invention, it is extremely advantageous if the depth of the elevations and depressions varies along the lines or in the height direction of the shell.

In this way, a shell can be designed which is of flat configuration, for example, at its upper edge and/or lower edge with decreasing elevations and depressions, or in which the elevations and depressions are of lower configuration in inner regions and thus ensure improved grip.

According to the invention, it is also extremely advantageous if the contact area between the inner surface and the outer surface of the cup is of reduced configuration.

The thermal transfer between the inner side and the outer side is reduced by a reduced contact area.

It has proven very advantageous here if the elevations are configured in such a way that the inwardly directed contact area is smaller than that of the outwardly directed elevations, at least in the gripping region.

This ensures satisfactory and pleasant handling. Nevertheless, very satisfactory insulation is ensured with low thermal transfer.

A further very advantageous refinement of the invention is also present if the elevations are configured in such a way that the inwardly directed contact area is larger than that of the outwardly directed elevations at least in the gripping region.

This likewise achieves a considerable reduction in the contact area between hand and cup, as a result of which lower thermal transfer takes place. The cup can therefore also be held without problems in the case of very hot or very cold contents, even if the cup is of single-layer configuration.

In this context, it has proven extremely advantageous if the ratio between the inner contact area and the outer surface is 1:2.

This achieves particularly low thermal transfer and a very satisfactory insulating effect.

According to the invention, it has also proven very advantageous if the shell has at least one region which is of substantially smooth configuration.

It has proven very advantageous here if information items are provided in the smooth region.

It is likewise also advantageous if embossed formations are provided in the smooth region.

In this smooth region, advertising or else other information items can be provided by ink application and/or by embossed formations.

One very advantageous development of the invention is also present if the shell which is configured with multiple layers has at least two embossed layers.

It has proven very advantageous here if the embossed formations of the layers are directed counter to one another.

This achieves very satisfactory insulation of the shell.

According to the invention, it is also extremely advantageous if the embossed formations of the layers bear against one another.

As a result, a comparatively large spacing is provided between the layers even in the case of a low embossing depth. In addition, embossed formations of this type are very stable.

However, it is also very advantageous if the shell which is configured with multiple layers has a smooth layer.

Very satisfactory printability can be achieved if the smooth layer is directed to the outside.

It has proven very advantageous here if a smooth layer is provided as inner layer of the shell and it is joined sealingly to itself and to the base.

As a result, the contents of the cup are not capable of accumulating on embossed formations.

A further refinement which is very advantageous according to the invention is also present if the layers are joined sealingly to one another at their upper and/or lower end.

As a result, the penetration of liquid, dirt, dust or the like between the layers can be prevented.

It is likewise very advantageous if the shell and/or the layers are adhesively bonded to itself/themselves.

An outer shell or layer is provided in this way which can subsequently be pushed over the cup very easily.

A further development which is very advantageous according to the invention is also present if the shell is of overlapping configuration and if the second, outer end of the shell is equipped with an adhesive bond which is arranged set back with respect to the outer end.

This avoids adhesive being capable of escaping at the end edge of the shell. The setting-back distance can also be so great that the adhesive bonding of the second end takes place with the inner shell.

Furthermore, it has proven extremely advantageous if the mouth roll is integrally formed on the inner layer.

This achieves greater comfort when the cup is used.

In addition, it has proven very advantageous according to a further development of the invention if the outer layer has an anti-slip means which is provided by the elevations of different heights.

This once again improves the handling of the cup. Accidental slipping out is avoided. In addition, the cup nestles very pleasantly in the hand of a user.

A further very advantageous refinement of the invention is also present if the outer layer has at least one thickened portion.

It has proven very advantageous here if the thickened portion is provided in the central vertical region of the cup.

This also achieves very satisfactory grip and also anti-slip protection of the cup.

A further very advantageous development of the invention is also present if at least one perforation is provided in the shell.

It has proven extremely advantageous here if the perforation is provided in the outer shell.

A refinement of this type results in many design options.

It is extremely advantageous according to the invention if a perforation is provided at the upper and/or lower end of the shell.

This ensures that air can flow within channels which run at least approximately in the direction of the cup height. The air enters at the lower end of the cup and exits again at the upper end of the cup, as long as the cup contents are warmer than the surroundings. The flow is generated by convection. A flow which is directed in the other direction is additionally conceivable in the case of cold cup contents.

It is likewise very advantageous if a coupon is provided which is delimited from the remaining shell by a perforation.

In this way, vouchers or other advertisements, for example, can be attached to the cup.

A further very advantageous refinement of the invention is also present if the outer shell covers part of the cup height.

In this way, the outer, insulating shell can be provided in the gripping region.

It is likewise very advantageous if the outer shell has recesses.

For example, viewing windows showing the inner shell or else the filled product can be produced by means of these recesses.

In the following text, the invention will be illustrated using several exemplary embodiments.

Figure 2:
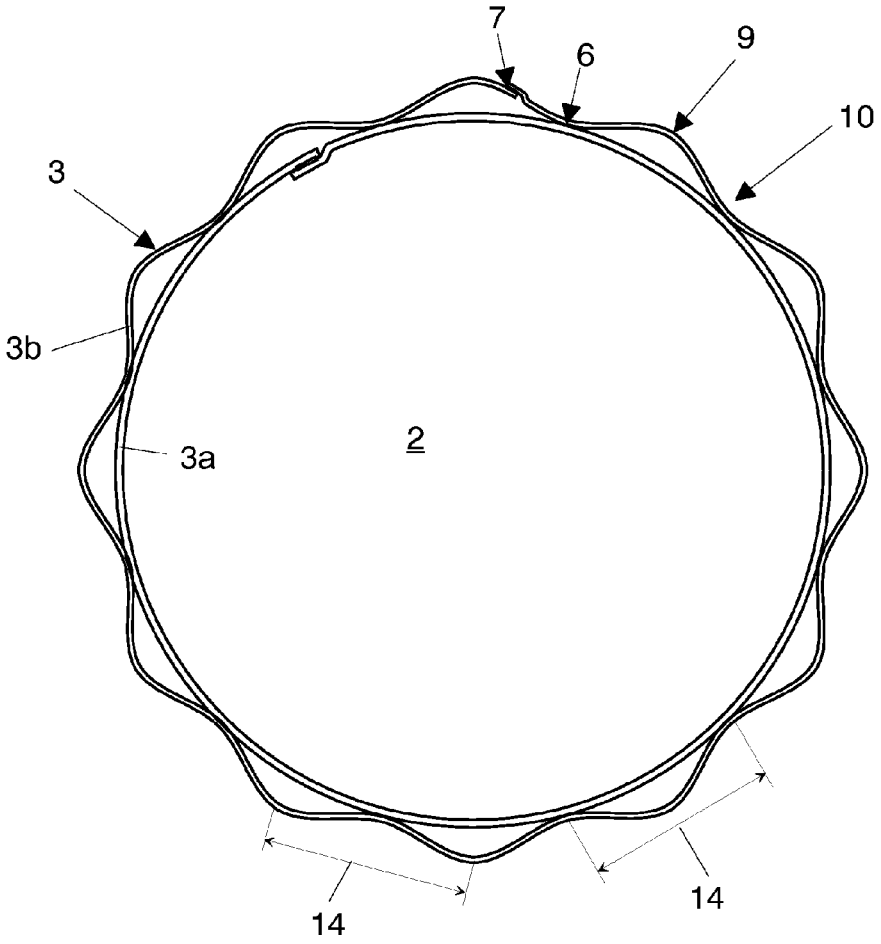
Figure 3:
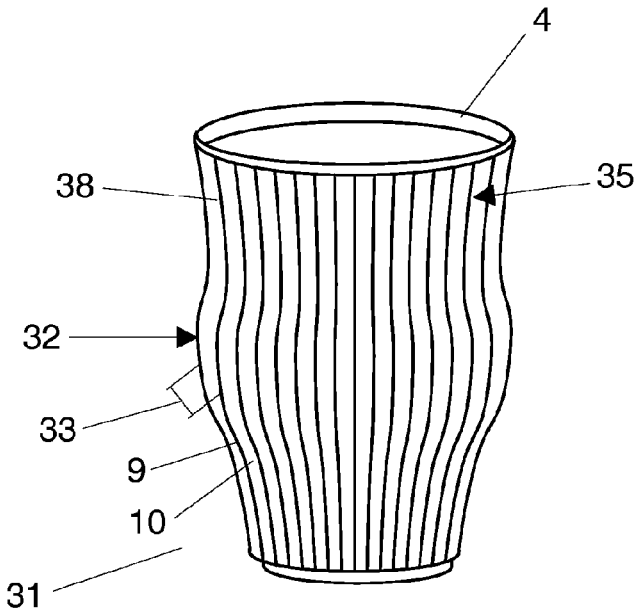
Figure 4:
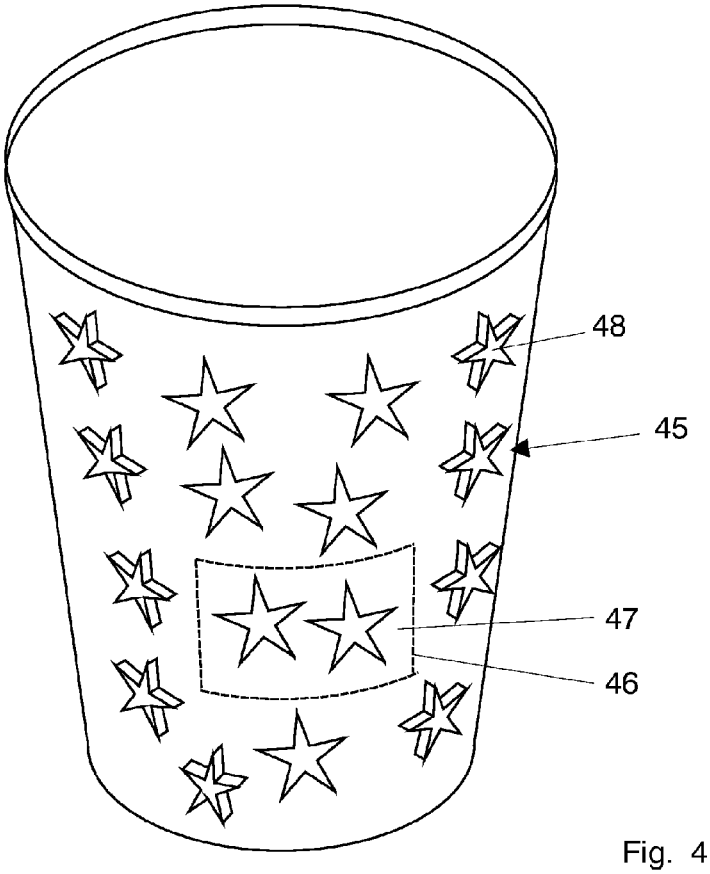
Figure 5:
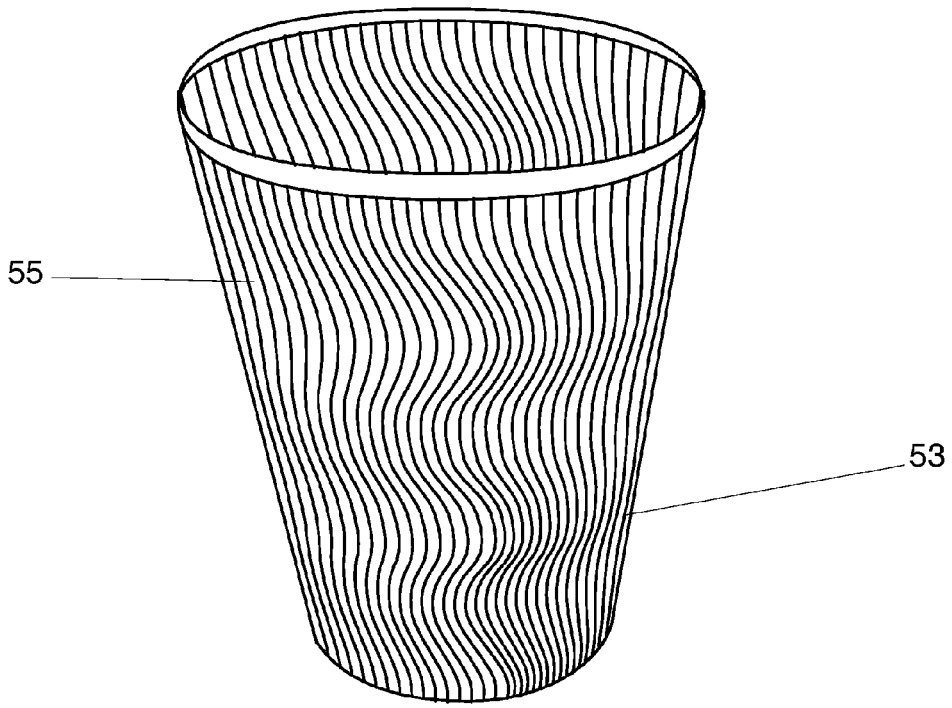
Figure 6:
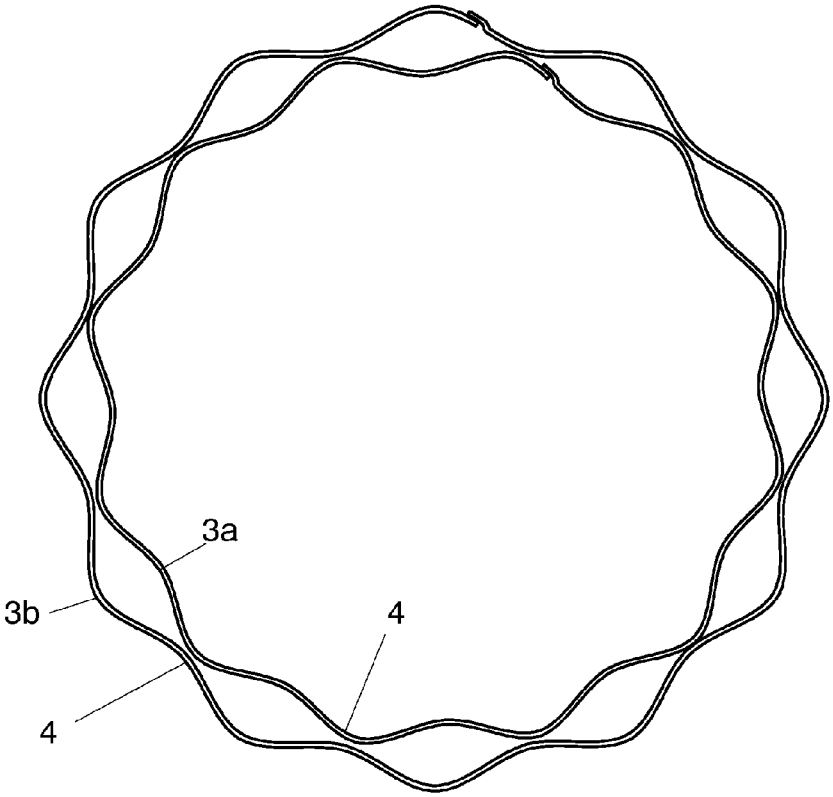
Figure 7:
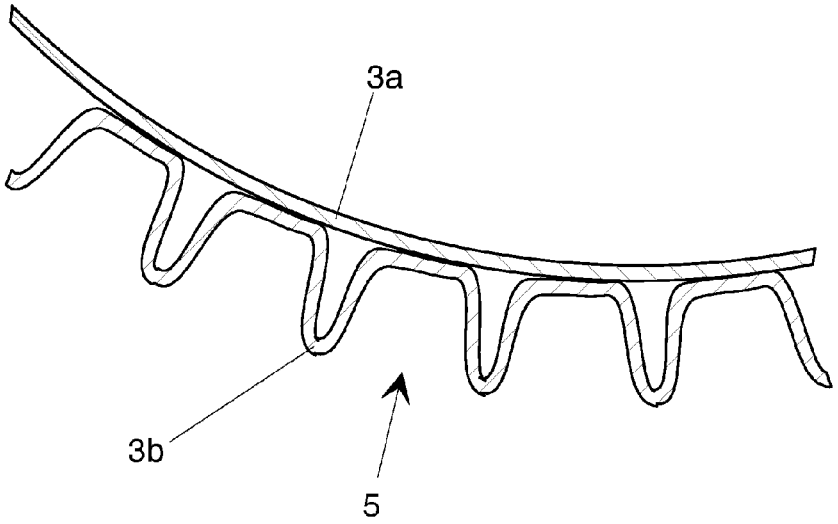
Figure 8:
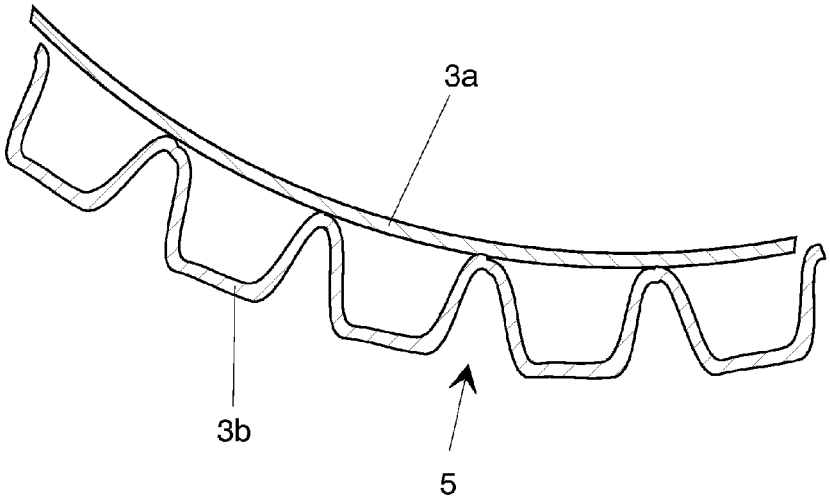
Figure 9:
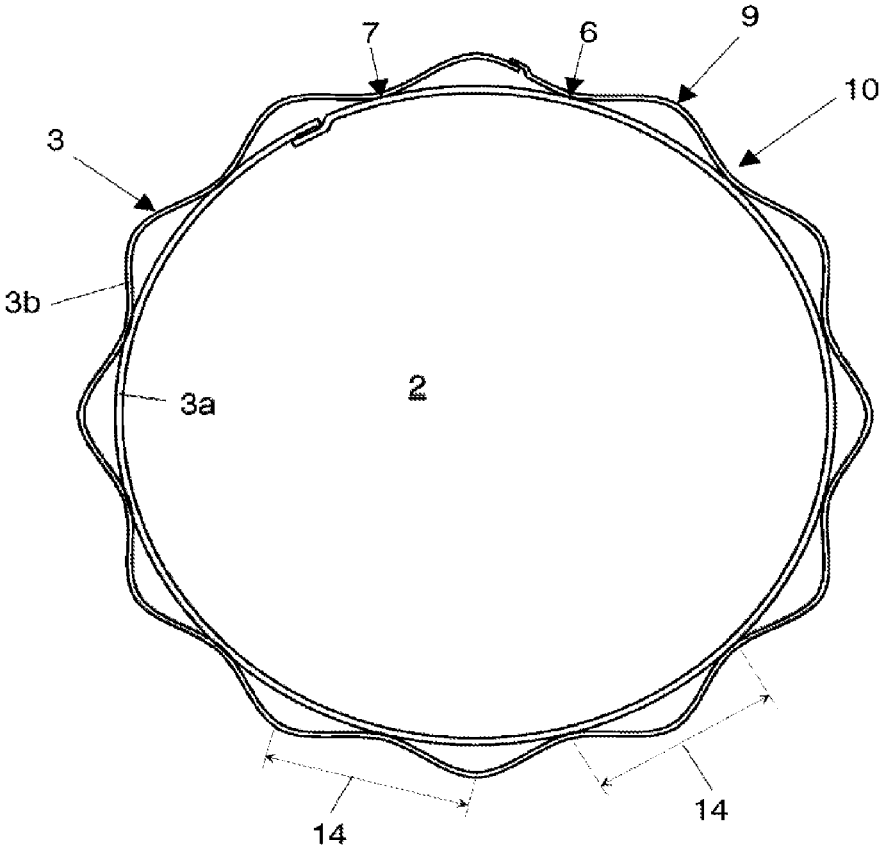

In the drawing:

FIG. 1 shows a double-walled cup having a smooth inner shell and an outer shell which is provided with undulating elevations and depressions, FIG. 2 shows a section through the shell of this cup, FIG. 3 shows a double-walled cup having a smooth inner shell and an outer shell which is provided with elevations and depressions in the form of lines, FIG. 4 shows a double-walled cup having a smooth inner shell and an outer shell which is provided with dedicated elevations and depressions, FIG. 5 shows a single-walled cup, the shell of which is provided with elevations and depressions in the form of wavy lines, FIG. 6 shows a section through a double-walled cup having an embossed inner and outer layer, FIG. 7 shows a section through a cup having an outer shell, in which the outer face is smaller than the contact area of the outer shell on the inner cup, FIG. 8 shows a section through a cup having an outer shell, in which the outer face is larger than the contact area of the outer shell on the inner cup, and FIG. 9 shows a section thorough the shell of the cup in FIG. 1 according to an alternative embodiment of the present invention.

In FIG. 1, 1 denotes a cup which is produced from paper or cardboard with a base 2 and a shell 3. A mouth roll 4 which is wound to the outside and covers the opening of the cup 1 is attached at that end of the shell 3 which faces away from the base 2.

In the first exemplary embodiment, the shell 3 of the cup 1 is of double-walled configuration and comprises an inner shell 3*a* which is produced from smooth material and an outer shell 3*b* which is provided with a structure 5 and is placed around the inner shell 3*a*. Here, a first end of the outer shell 3*b* is joined to the inner shell 3*a* along the height direction by an adhesive seam 6 which can be arranged set back with respect to the end. Here, the adhesive seam 6 can preferably be set back between one and eight millimeters, in order to avoid the adhesive which is used for the adhesive seam 6 escaping at the end. The adhesive seam 6 can also be made up of discrete points or other geometric designs. A very wide variety of hot-melt adhesives, cold adhesives or else dispersion adhesives can be used for the adhesive seam 6, depending on the intended use of the cup 1 and the materials which are used.

The second end of the outer shell 3*b* can overlap the first end and is fastened in the region of the first end by way of a further adhesive seam 7.

The two ends of the outer shell 3*b* can overlap one another. It is conceivable that the overlap is between one and ten millimeters. However, it is also conceivable that the ends only butt against one another or even assume a slight spacing from one another, which spacing should not exceed one millimeter.

Here, the outer shell 3*b* is first of all adhesively bonded at the first end and is then wound around the inner shell 3*a*.

The adhesive seam 7 can either fasten the second end to the first end of the outer shell 3*b* or else to the inner shell 3*a*. The same adhesives can be used as in the adhesive seam 6.

The adhesive seam 7 can also be arranged set back from the end, with the result that there is also the option that the second end of the outer shell 3*b* is adhesively bonded directly to the inner shell 3*a* despite an overlap with the first end.

The inner shell 3*a* overlaps at its ends and is adhesively bonded sealingly.

The outer shell 3*b* is provided with wavy lines 8 which run substantially in the height direction of the shell 3 and form the structure 5. Here, the wavy lines 8 form elevations 9 and depressions 10. Here, however, the designations elevations 9 and depressions 10 do not necessarily denote that they are elevated or depressed in each case with respect to a zero position which is defined, for example, by the original paper plane. Rather, the elevations 9 and the depressions 10 describe elevations and depressions with respect to one another.

The height of the elevations 9 and depressions 10 can change over the shell height. In this exemplary embodiment, a plurality of regions 11 of less pronounced configuration of the elevations 9 and the depressions 10 are arranged which run around the outer shell 3*b*. Other arrangements are conceivable.

As a result of these regions 11, the outer shell 3*b* is easier to grip. In addition, an anti-slip means is formed which prevents accidental slipping. Nevertheless, this refinement does not impede the stacking capability of a plurality of cups 1 in one another.

In addition, smooth regions 12 can be provided which can carry information items which are printed or else embossed. It is also possible that logos or the like are arranged in these regions 12. The region 12 represents, for example, a slightly depressed, circular area which carries a logo.

Channels are formed by the structure 5 of the outer shell 3*b*, which channels run at least approximately in the height direction of the shell and are closed by the inner shell 3*a*, so that real, closed channels result here which can be open at their ends.

The air which is contained in the channels ensures a very satisfactory insulating effect. If, for example, a hot or cold drink is filled into the cup 1, the cup 1 can nevertheless be handled very satisfactorily, since the outer side of the outer shell 3*b* does not take on the high or low temperature of the drink. The temperature equalization of the drink with the surroundings is likewise reduced.

If the channels are open at their ends, a cooling effect can also be achieved by the convection of air which occurs through the channels, for example for hot drinks such as coffee or the like, in order to cool the drink more quickly to a temperature which is conducive to drinking.

It is also conceivable that perforation openings 13 are provided at the upper and lower edges of the outer shell 3*b*, which perforation openings 13 make an unimpeded entry and exit of air possible from the channels.

Furthermore, it is conceivable that the outer shell 3*b* has such a high inherent rigidity that it bears against the inner cup 3*a* only in predefined regions, preferably at the upper and/or lower edge, and otherwise is at a spacing from the inner cup 3*a*, as a result of which an even more satisfactory insulating effect is achieved.

It is also conceivable that the outer shell 3*b* itself is configured with multiple layers. Here, a smooth layer can be applied to the structured layer and can be joined to it. The smooth layer can be arranged either on the inner side or outer side.

It is also conceivable that the cup 1 comprises a plastic or any other desired materials and only the outer shell 3*b* is produced from paper or cardboard.

The outer shell 3*b* can also be produced separately from the cup 1 and can subsequently be pushed onto the cup. The static friction is often sufficient here. An adhesive join is conceivable.

The above-described adhesive bonding can also have further adhesive points on the circumference of the cup 1. It is also conceivable, for example, that the adhesive bonding takes place along the circumference of the cup 1. Here, one or more adhesive points or adhesive lines can be provided.

FIG. 2 shows a section through the shell 3 of the cup 1, with the result that the channels can be seen which are formed from the elevations 9 and depressions 10.

The spacing 14 between two adjacent elevations 9 or depressions 10 can vary over the height of the shell 3. In this first exemplary embodiment, the spacing 14 is greater in an upper region of the shell 3 than in a lower region of the shell 3. These different spacings provide a compensation with regard to the available material, which compensation provides an adaptation to different diameters over the height of the cup 1. This adaptation avoids folds or the like in the outer shell 3*b*.

As a result, there is also the option in some circumstances to use only slightly elastic papers or cardboards for the outer shell 3*b*.

FIG. 3 shows a further refinement of the invention. The cup shown here is denoted by 31. Here, a structure 35 which is formed from parallel lines 38 is provided instead of the structure 5 which is formed from wavy lines 8.

The outer shell 3*b* has a bulge in a central region 32. This results in a circumferential thickened portion of the outer shell. This thickened portion is produced by a greater spacing 33 of the lines 38 in this region. The greater spacing 33 can be accompanied by a greater height of the elevations 9 and depressions 10.

FIG. 4 shows a further refinement of the invention. Here, discrete embossed formations 48 are provided which in their plurality together form a structure 45.

As in the first exemplary embodiment, the height of the embossed formations can also vary in this exemplary embodiment. For example, logos or the like can be used as embossed formations 48.

It is also conceivable in all these multiple-layer refinements that a perforation 46 is provided which surrounds a shell region 47 which can be severed as a coupon.

However, single-layer shell designs are also conceivable. FIG. 5 shows one refinement which exhibits a shell 53 of this type which is formed only from the structured outer shell 3*b*.

Once again, the shell 53 has a depth of the structure 55 which varies over the shell height 53. In this example, the structure 55 decreases towards the upper and lower edges of the shell 53, with the result that the mouth roll 4 can be arranged very easily and a sealed connection to the base 2 can be provided.

However, it is also conceivable here that the depth also varies to a greater extent.

A very wide variety of embossed formations of the structuring are also conceivable in the single-layer refinement.

In one exemplary embodiment, the depth of the structuring lies in the range between 0.1 and 2.5 millimeters; the spacing between adjacent elevations 9 or depressions 10 should be between 0.1 and 3 millimeters. The transition radii between the elevations 9 and the depressions 10 can be in the range between 0.5 and 1.25 millimeters.

The shell 3*b* can be structured in such a way that it represents, for example, a landscape or other depictions. Here, the structuring can be accentuated further by corresponding coloring. Here, the coloring can be aligned to the embossed formations.

The discrete embossed formations 48 can comprise logos, image elements or any other desired representations, for example also text elements, which then together form a structuring of the shell 3*b*.

According to the invention, it is also conceivable if the outer shell 3*b* takes up only part of the cup height. The outer shell can therefore be limited, for example, to the gripping region. The additional material for the outer shell 3*b* is saved in regions which do not require insulation. The outer shell 3*b* can also be limited to defined regions which require stabilization.

In this context, it is also conceivable that the outer shell 3*b* has recesses. These recesses can, for example, open the view of the inner shell 3*a* or, if the latter is transparent, also of the contents of the cup. Material for the outer shell 3*b* is also saved in this variant.

It is also conceivable that both the outer shell 3*b* and the inner shell 3*a* are structured or embossed, as is shown in FIG. 6.

The embossed formations 4 of the two layers 3*a* and 3*b* are directed at least partially counter to one another, as a result of which the spacing of the layers is increased.

It is also conceivable that the structuring 5 is configured in such a way that the area which faces the inner shell 3*a* is larger than the area which faces outwards.

As a result of this refinement, the thermal transfer between the cup 1 and the hand of the user is reduced. Cups which contain very hot or very cold filling product can therefore also be held. In the example which is shown, the ratio between the areas is approximately 1:2.

Here, the outwardly facing area can also be less or more than 50% of the inwardly facing area.

A refinement of this type has proven very effective not only in the case of multiple-layer cups, as shown in FIG. 7, but above all in the case of single-layer cups.

It is also conceivable that the outwardly directed area is also larger than the inwardly directed area, as is shown in FIG. 8.

This is possible, above all, in the case of multiple-layer constructions. The greater outer area ensures pleasant handling, a very satisfactory insulating effect nevertheless being achieved.

Despite this refinement, the cup 1 can still be held very pleasantly. In particular, no unpleasant pressure points are produced. This is, above all, due to the changing depths of the structuring.

The invention claimed is:

1. Cup comprising a base and an adjoining shell having an innermost layer and an outermost layer produced from paper or cardboard, wherein the outermost layer of the shell is provided with a plurality of elevations and depressions substantially over its entire height and at least approximately the entire circumference;

wherein the outermost layer wraps around the innermost layer and includes a first end and a second end, the first end joined to the innermost layer along the height direction by a first adhesive seam set back from the first end and the second end joined to the innermost layer along the height direction by a second adhesive seam set back from the second end, the second end overlapping the first end in the height direction;

wherein the innermost layer at least partially contacts the outermost layer along the depressions provided on the outermost layer;

wherein the innermost layer does not contact the outermost layer along the elevations provided on the outermost layer; and wherein each elevation and depression is arranged in the form of a line that is wavy extending in a generally vertical direction and running approximately the entire height of the shell.

2. Cup according to claim 1, wherein the spacing between two adjacent said elevations or two adjacent said depressions varies over the height of the shell.

3. Cup according to claim 1, wherein the elevations and depressions are formed as a plurality of embossed formations individually spaced and collectively spanning approximately the entire height of the shell.

4. Cup according to claim 1, wherein a width of each elevation is greater than a width of each depression at least in a gripping region by a ratio of approximately 2:1, wherein the width of each depression is the width of an area where the outermost layer is in contact with the innermost layer.

5. Cup according to claim 1, wherein the shell has at least one region wherein one or more information items and/or one or more embossed formations are provided.

6. Cup according to claim 1, wherein the innermost layer is provided with a plurality of elevations and depressions, and wherein the elevations of the innermost layer at least partially in contact the depressions of the outermost layer.

7. Cup according to claim 1, wherein the innermost layer is a smooth layer, and wherein the innermost layer of the shell is joined sealingly to itself and to the base.

8. Cup according to claim 7, wherein the innermost layer and the outermost layer are joined sealingly to one another at their upper and/or lower ends.

9. Cup according to claim 1, wherein at least one perforation is provided in the outermost layer at an upper and/or lower end of the shell, and wherein a coupon is delimited from the remaining shell by the at least one perforation.

10. Cup according to claim 9, wherein the outermost layer covers part of the cup height, and wherein the outermost layer has recesses.

11. Cup according to claim 1, wherein along a first cup height, a first depth between a first most outwardly extending portion of a first said elevation and a first most inwardly extending portion of a first adjacent said depression is greater than a second depth between a second most outwardly extending portion of a second said elevation and a second most inwardly extending portion of a second adjacent said depression, wherein the first adjacent said depression is adjacent to the first said elevation and the second adjacent said depression is adjacent to the second said elevation.

12. Cup according to claim 1, wherein a first distance between a most inwardly extending portion of a first said depression and a most outwardly extending portion of an adjacent said elevation at a first height is less than a second distance between the most inwardly extending portion of the first said depression and the most outwardly extending portion of the adjacent said elevation at a second height, and wherein the adjacent said elevation is adjacent to the first said depression along the height of the shell.

13. Cup comprising a base and an adjoining shell having an innermost layer and an outermost layer produced from paper or cardboard, wherein the outermost layer of the shell is provided with a plurality of elevations and depressions substantially over its entire height and at least approximately the entire circumference;

wherein the outermost layer wraps around the innermost layer and includes a first end and a second end, the first end joined to the innermost layer along the height direction by a first adhesive seam set back from the first end and the second end joined to the innermost layer along the height direction by a second adhesive seam set back from the second end, the second end overlapping the first end in the height direction;

wherein the innermost layer at least partially contacts the outermost layer along the depressions provided on the outermost layer;

wherein the innermost layer does not contact the outermost layer along the elevations provided on the outermost layer;

wherein each elevation and depression is arranged in the form of a line that is wavy extending in a generally vertical direction and running approximately the entire height of the shell; and wherein the outermost layer has at least one thickened portion, and wherein the at least one thickened portion is provided in a central region of the height of the shell.

14. Cup comprising a base and an adjoining shell having an innermost layer and an outermost layer produced from paper or cardboard, wherein the outer most layer of the shell is provided with a plurality of elevations and depressions substantially over its entire height and at least approximately the entire circumference;

wherein the outermost layer wraps around the innermost layer and includes a first end and a second end, the first end joined to the innermost layer along the height direction by a first adhesive seam set back from the first end and the second end joined to the innermost layer along the height direction by a second adhesive seam set back from the second end, the second end overlapping the first end in the height direction;

wherein the innermost layer at least partially contacts the outermost layer along the depressions provided on the outermost layer;

wherein the innermost layer does not contact the outermost layer along the elevations provided on the outermost layer;

wherein each elevation and depression is arranged in the form of a line that is wavy extending in a generally vertical direction and running approximately the entire height of the shell; and wherein a width of each depression is greater than a width of each elevation at least in a gripping region by a ratio of approximately 2:1, wherein the width of each depression is the width of an area where the outermost layer is in contact with the innermost layer.

15. Cup comprising a base and an adjoining shell having an innermost layer and an outermost layer each produced from paper or cardboard, wherein the outermost layer of the shell is provided with a plurality of elevations and depressions substantially over an entire height of the shell and at least approximately an entire circumference of the shell;

wherein the innermost layer extends substantially an entire height of the cup and the outermost layer extends substantially the entire height of the cup;

wherein the innermost layer at least partially contacts the outermost layer along the depressions provided on the outermost layer;

wherein the innermost layer does not contact the outermost layer along the elevations provided on the outermost layer;

wherein the elevations and depressions are created by a plurality of discrete embossed formations configured as shaped elements individually spaced and collectively spanning approximately the entire height of the shell and the entire circumference of the shell; and wherein the outermost layer includes a first end and a second end, wherein the first end is joined to the innermost layer along the height direction by a first adhesive seam set back from the first end, and wherein the second end is joined to the innermost layer along the height direction by a second adhesive seam set back from the second end, and wherein the second end overlaps the first end in the height direction.

* * * * *